US006460292B1

(12) United States Patent
Rodriguez et al.

(10) Patent No.: US 6,460,292 B1
(45) Date of Patent: Oct. 8, 2002

(54) BARRIER GATE ARM ASSEMBLY AND METHODS FOR USE THEREOF

(76) Inventors: Carlos A. Rodriguez, 9014 Stoney Bend Dr., Spring, TX (US) 77379; Robert E. Castaneda, 14230 Wunderlich Apt. 138, Houston, TX (US) 77069

( * ) Notice: Subject to any disclaimer, the term of this patent is extended or adjusted under 35 U.S.C. 154(b) by 0 days.

(21) Appl. No.: 09/350,866

(22) Filed: Jul. 9, 1999

(51) Int. Cl.[7] ..... E01F 13/00
(52) U.S. Cl. ..... 49/49; 49/246; 16/320
(58) Field of Search ..... 49/49, 9, 246, 49/247, 226; 16/297, 320

(56) References Cited

U.S. PATENT DOCUMENTS

| | | | | |
|---|---|---|---|---|
| 1,356,302 | * | 10/1920 | Mills | 49/9 |
| 1,665,157 | * | 4/1928 | Dahnke | 49/49 |
| 3,016,563 | * | 1/1962 | Jong | 16/320 |
| 3,562,850 | * | 2/1971 | Eliason et al. | 16/320 |
| 4,219,969 | | 9/1980 | Reinitz et al. | 49/141 |
| 4,227,344 | * | 10/1980 | Poppke | 49/9 |
| 4,364,200 | | 12/1982 | Cobb | 49/192 |
| 4,531,325 | | 7/1985 | Phillips | 49/49 |
| 4,655,002 | * | 4/1987 | Everson | 49/9 |
| 4,811,516 | | 3/1989 | Anderson | 49/49 |
| 5,138,796 | | 8/1992 | Grainger | 49/238 |
| 5,442,878 | * | 8/1995 | Flores | 49/49 |
| 5,452,964 | * | 9/1995 | Troughouboff | 49/49 |
| 5,653,058 | | 8/1997 | Zaimins | 49/208 |
| 5,671,563 | * | 9/1997 | Marcum | 49/49 |

* cited by examiner

*Primary Examiner*—Curtis A. Cohen
(74) *Attorney, Agent, or Firm*—Umesh M. Desai

(57) ABSTRACT

The present device is directed to a new and improved barrier gate assembly which comprises an automatic vehicle gate operating mechanism and a barrier arm assembly. The barrier arm assembly, attached to the automatic vehicle gate operating mechanism, comprises of a bracket assembly with a hinge assembly attached thereto. The hinge assembly, having a pivot axis transverse to the bracket assembly, pivotally joins the bracket assembly to a plate assembly permitting pivotal movement of the plate assembly away from the bracket assembly. The plate assembly is fixedly attached to the hinge assembly for securing and holding a barrier arm. The barrier arm longitudinally extends from the plate assembly. A magnet-type device is provided on the bracket assembly in alignment with the plate assembly to hold both the plate assembly and the barrier arm in place next to the bracket assembly while preventing pivotal movement of the hinge assembly and thereby the extended barrier arm. Additionally, the hinge assembly is mounted at a transverse angular pivot axis such that whenever the barrier arm is impacted by a vehicle, the barrier arm retracts to it's normal operating position by the force of gravity acting on it. A method for use of the new and improved barrier gate assembly is also disclosed.

2 Claims, 2 Drawing Sheets

BARRIER GATE ARM ASSEMBLY AND METHODS FOR USE THEREOF

BACKGROUND OF THE INVENTION

1. Field of the Invention

This invention relates generally to an improved low maintenance barrier gate device and methods for use thereof to regulate vehicle movement at a barrier point. More particularly, but not by way of limitation, the barrier arm assembly is designed to clear away whenever a vehicle impacts the barrier arm assembly should a vehicle, accidentally or otherwise, ram the barrier arm assembly or if the barrier gate device malfunctions and the barrier arm assembly lowers onto an intervening vehicle. Thus, the present invention prevents damage to the vehicle while also, importantly, preventing breakage of the barrier arm assembly.

2. Description of the Prior Art

Today, it is very common to see automatically operable vehicle barrier gate devices in most commercial parking lots and garages. These barrier gate devices are used to control and regulate traffic into and from parking areas and buildings. Other major uses of barrier gate devices include operation at toll stations on major highways. Toll highways use these devices to regulate vehicular traffic while collecting toll from all passing vehicles. Typically, a rigid elongate arm is horizontally extended across a barrier point to regulate traffic preventing unauthorized vehicular traffic.

In the case of toll highways, many toll stations operate barrier gate devices which are equipped with electronic means which detect and lift barrier arm assemblies with automatic motor gear mechanisms. These mechanisms are activated when pre-authorized vehicles approach the barrier points. The barrier arm assembly is then automatically lowered once the authorized vehicle has cleared the barrier point. These barrier gate devices are also used where toll is collected from vehicles that have not been pre-authorized and individual vehicles deposit toll coins before being allowed to pass through the barrier point.

At barrier points with relatively high traffic volumes, it is not uncommon that the barrier arm assemblies become lowered onto an Intervening vehicle. Such a vehicle may include an unauthorized vehicle that is trying to follow closely behind an authorized vehicle through the barrier point. Alternatively, the automatic gate may malfunction and prematurely lower onto an intervening authorized vehicle. More advanced automatic gates sense the impact of the arm on the vehicle and automatically raise the arm back up again. However, the impact of the arm on the vehicle against the moving vehicle before the motion of the arm is reversed and the arm is raised often causes considerable damage. Additionally, in many cases, where a breakable barrier arm assemblies are provided, considerable expense is incurred in replacing these arms.

As a result, new and unique problems, particularly, in the toll highway situation have arisen. Historically, the cost for replacing barrier gate arms for parking lots and buildings has been relatively minimal. However, in the case of toll highways, this expense has become a major burden for highway departments since, not only do the barrier arms assemblies have to be replaced but, a regular maintenance crew be employed at all times. Thus, in the case of toll highways where traffic is considerable and where traffic is moving at rapid speeds, breakage of barrier arms has increasingly become a major cost item not to mention damage to vehicles. As a result, a new device and method is needed to provide a creative solution to the unique problems not previously encountered at conventional barrier points.

Various prior art barrier gate devices have existed but none provide a solution for a re-useable cost effective barrier gate that prevents arm breakage useable in high traffic situations. For example, Phillips discloses in U.S. Pat. No. 4,531,325 a hinged vehicle gate arm that is mounted for automatic traffic control on a gate operating mechanism. The arm includes a first section mounted to the gate operating mechanism and a second section attached to the first section by a hinge assembly for pivotal deflection of the second section upwardly of the first section. A resilient roller is mounted for longitudinal rotation below and substantially the length of the second section. The resilient roller and hinged section limit damage to a vehicle contacted by the arm lowered by the gate operating device. However, this teaching is not directed to the problems encountered herein.

Another teaching is that by Cobb in U.S. Pat. No. 4,364,200 who discloses an automatically operable automotive vehicle gate apparatus provided with self protection and automotive protection. The gate apparatus includes operational mechanism which moves a gate member within a gateway between a closed position and an open position. The gate apparatus also includes structure which permits the gate member to be moved to an open position when opening forces are applied thereto, without operation of the operational mechanism. Thus, the gate apparatus is protected against damage. The gate apparatus also includes mechanism which permits the gate operation mechanism to move from an open position to a closed position while the gate member remains in an open position. Thus, if an automotive vehicle should be within the gateway when closing action of the gate operation mechanism occurs, the automotive vehicle is protected against damage. Again, however, this teaching is not directed to the problems encountered herein.

Another teaching is that of Anderson in U.S. Pat. No. 4,811,516 who discloses a barrier gate arm useful in controlling exits such as in parking lots is provided comprising a stiffening member, preferably of wood, encased in an extruded sheath, or sleeve made from polycarbonate. The arm provides for easy operation and for a quick repair after the inevitable damage by offending vehicles. However, again, such a teaching is not directed to the specific problems encountered herein.

Other teachings include those disclosed in the following U.S. Pat. Nos. 4,219,969; 5,653,058 and 5,138,796. However, none of these referenced patents teach a solution to the issues presented here.

Therefore, there is a need for a cost-effective and efficient method and apparatus for regulating vehicular traffic through barrier points.

SUMMARY OF THE INVENTION

In the present invention, a barrier gate assembly comprises an automatic vehicle gate operating mechanism and a barrier arm assembly. The barrier arm assembly, which is attached to the automatic vehicle gate operating mechanism, comprises of a bracket assembly with a hinge assembly attached to the bracket assembly. The hinge assembly, having a pivot axis transverse to the bracket assembly, pivotally joins the bracket assembly to a plate assembly permitting pivotal movement of the plate assembly away from the bracket assembly. The plate assembly is adjoiningly aligned with the bracket assembly during a closed and normal operational position. The plate assembly is fixedly attached to the hinge assembly for securely extending a barrier arm. The barrier arm longitudinally extends from the plate assembly. To hold the plate assembly and the barrier arm in place adjoining the bracket assembly while preventing pivotal movement of the hinge, a magnet is provided on the bracket assembly in alignment with the plate assembly which thereby firmly holds in place the metallic plate assembly and the extending barrier arm next to the bracket assembly. In the alternative, a spring-adapted hinge mechanism may be used. However, the use of a spring hinge assembly also places obvious limitations on the present invention.

Additionally, the hinge assembly may be mounted at a transverse angular position. The angular positioning of the pivot axis provides an added advantage such that, whenever the barrier arm is impacted by a vehicle thus overcoming the force of the magnet, the hinge and plate assembly along with the barrier arm swing open allowing the vehicle to pass without breaking the barrier arm or damaging the vehicle. Once the vehicle has passed the barrier gate assembly, the barrier arm retracts to it's normal operating position by the force of gravity acting on the weight of the barrier assembly. Later, as the plate assembly retracts, the magnetic force draws the plate assembly towards the bracket assembly resulting in the two assemblies once again being aligned in an adjoining manner. The magnetic forces also keep the plate assembly and the barrier arm in an adjoining position as the barrier arm assembly opens and closes during normal operation of the barrier point.

It is therefore an object of the invention to provide a barrier gate assembly, operable by a conventional automatic vehicle gate operating mechanism, which protects against damage to an intervening vehicle when it collides with the barrier gate arm assembly. It is a further object of the invention to provide a barrier gate assembly which pivots a barrier arm away from its normal operating mode when confronted with a vehicular collision. Such a barrier gate assembly further comprises a magnetic-type device which maintains the barrier arm in place in a normal operating mode. The magnetic-type device also draws the barrier arm in a normal operating position. It is a further object of the invention to provide a barrier gate assembly which may be opened manually or fixed in an open position to permit vehicular traffic if the automatic vehicle gate operating mechanism malfunctions or if a power outage occurs. It is a further object of the invention to provide a barrier gate assembly which comprises a barrier arm made of Polyvinyl Chloride (PVC) material to absorb the impact and not allow breaking preventing expensive replacement costs during breakage.

Further, methods for operation and use of the barrier gate assembly are also disclosed. Additional objects, features and advantages will become apparent in the detailed description which follows.

DETAILED DESCRIPTION OF THE INVENTION

Figure 1:
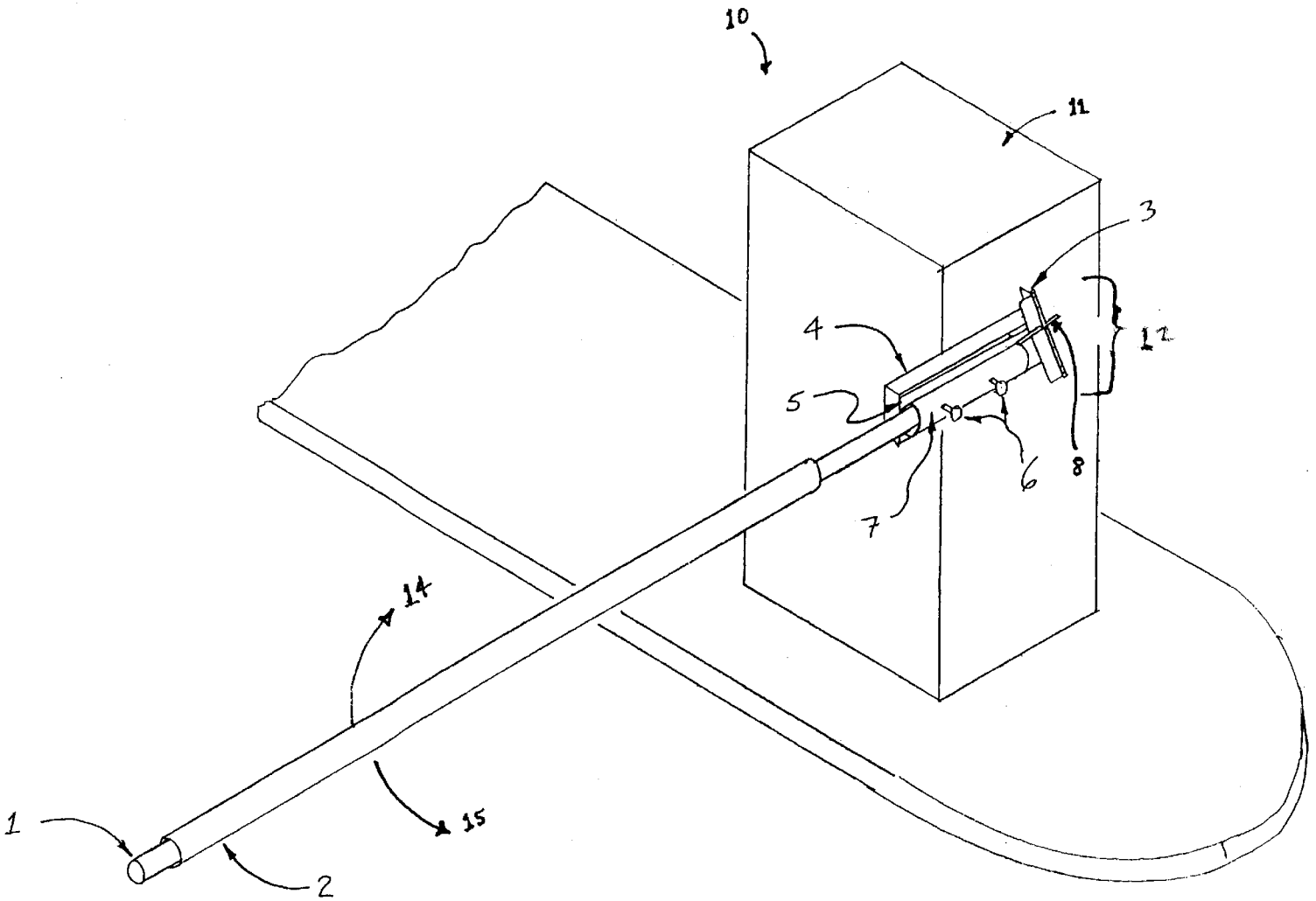
FIG. 1 is a perspective view of the barrier gate assembly of the present invention in a closed mode during normal operation.
Figure 2:
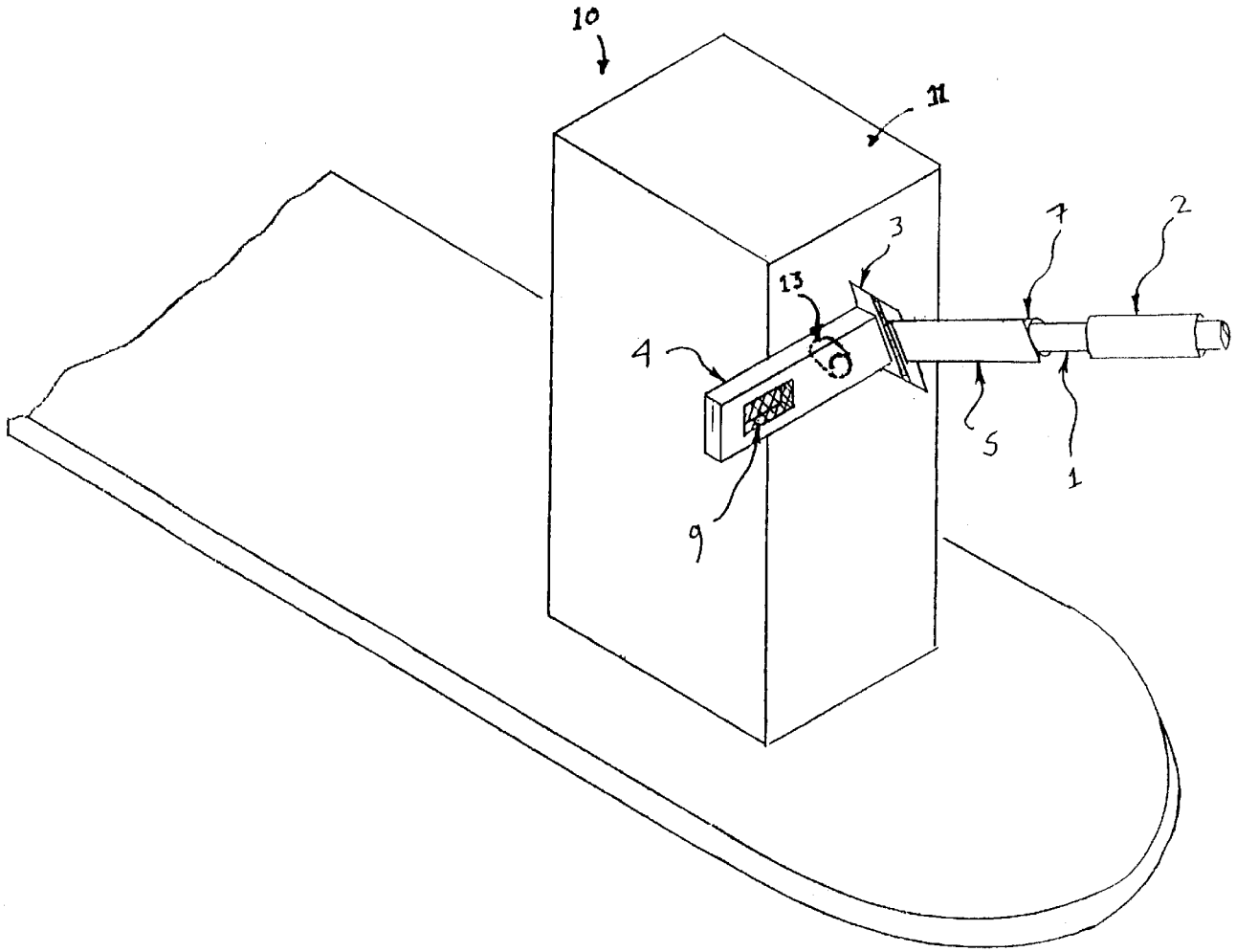
FIG. 2 is a perspective view of the barrier gate assembly of the present invention in a closed mode during normal operation that is now impacted by an external force of a vehicle which swings the barrier arm assembly away from the vehicle.

The present invention is best described and understood with reference to the context in which it is used and as further illustrated in the accompanying drawings. FIG. 1 shows the full barrier gate assembly in the normal operating mode that is closed. FIG. 2 shows the full barrier gate assembly in the normal operating mode that is closed but one that is impacted by an external force of a vehicle, and therefore, the barrier arm is swung open to allow an offending vehicle passage to pass through without damage to the vehicle or the barrier gate arm assembly.

Now referring to FIG. 1, a barrier gate assembly 10, is shown and comprises an automatic vehicle gate operating mechanism 11, and a barrier arm assembly 12 fixedly attached to the automatic vehicle gate operating mechanism 11. The automatic vehicle gate operating mechanism 11, comprises, in a preferred embodiment, a motorized gear mechanism (not shown) which turns the barrier arm assembly 12 into open and closed positions as vehicles pass through the barrier gate assembly 10. The automatic vehicle gate operating mechanism 11 comprises a rotating arm 13 which rotates in open and closed positions through an automated control mechanism which may include an electronic activating system. Thus, as the rotating arm 13 turns, it lifts the barrier arm assembly 12 into open and closed positions as necessary.

The barrier arm assembly 12 is designed so that it could fit into any motor gear shaft design as long as the motor torque is greater than the torque required to operate the barrier arm assembly 12. The barrier arm assembly 12 comprises a bracket assembly 4 mounted to the rotating arm 13 which is a part of the automatic vehicle gate operating mechanism 11. The bracket assembly 4 is preferably is made of metal to provide strong support for the rest of the barrier arm assembly 12. The bracket assembly 4 must be fixed to the rotating arm 13 in a relatively strong fixed relationship so as to transfer all of the torque of the rotating arm 13 to the barrier arm assembly 12 and so lift the barrier arm without difficulty. Thus, the bracket assembly 4 is preferably fixed to the rotating arm 13 with a bolt and nut combination or other like means. The barrier arm assembly 12 further comprises by a hinge assembly 3 that is attached to the bracket assembly 4. The axis of hinge assembly 3 is oriented so that it is transverse to the bracket assembly 4. In the preferred embodiment, the hinge assembly 3 is oriented to be in an angular position so as to promote the return of barrier arm assembly 12 to its resting position, primarily by means of gravity, under a normal mode of operation. Thus, a suitable angle must be chosen. Thus, the transverse axis angle of the hinge assembly 3 relative to a vertical axis of the automatic vehicle gate operating mechanism 11 may range from 10 to 30 degrees turned away from the vertical line for ideal operation. In other words, the top of the hinge assembly 3 compared to the bottom should be at an angle of about 10–30 degrees relative to the vertical. It is to be understood that such angular positioning is to be designed so as to promote the return of the barrier arm assembly 12 to it normal resting position by means of gravity. Of course, each barrier gate assembly is unique as compared to the surface level and so must accordingly be adjusted. Thus, the angular ranges provided herein are included as only as exemplary.

Now, continuing further description of the barrier arm assembly 12, FIGS. 1 and 2 disclose a plate assembly 5 attached to the hinge assembly 3 which is used to hold a barrier arm 1 in place. The plate assembly 5 is fixedly attached to the hinge assembly 3 with suitable means, including if preferred, welding them together. Thus, in the normal mode of operation, the plate assembly 5 and the bracket assembly 4 in perfect alignment so that the surface areas of each assembly are in contact with each other.

A magnetic-type device 9 is further fixedly attached to the bracket assembly 4 to prevent the barrier arm 1 from swinging out during the normal open and closed mode of operation. An example of a magnetic-type device 9 is a conventional magnet, a electromagnet. Another function of the magnetic-type device 9 is to allow the barrier arm 1 to swing open whenever a force greater than the magnetic force exerted by the magnetic-type device 9 is impacted against the barrier arm by an offending vehicle. Further, as the barrier arm 1 returns to its resting position by means of gravity, the magnetic-type device 9 functions to create magnetic forces which will attract or draw the plate assembly 5 back to the bracket assembly 4 to once again prevent the barrier arm 1 from swinging out. The magnetic-type 9 may be of an electromagnet although not necessary. In the alternative, a Velcro-type mechanism is also acceptable (not shown). Also, a spring-adapted hinge mechanism (not shown) may also be used. However, the use of a spring hinge assembly places obvious limitations on the present invention. A spring hinge assembly may not provide the best mode of releasing the barrier arm when a vehicle impacts it. However, in certain situations, this may be an acceptable alternative. It is to be understood that placing a spring hinge assembly instead of a magnet 9 does not substantially depart from the spirit of the present invention and such an alternative embodiment is included within the present invention.

Further a hinge assembly safety stop 8 is also provided on the hinge assembly so as to prevent the hinge from swinging out beyond a certain point. Thus, the hinge assembly safety stop 8 prevents the barrier arm from swinging out completely avoiding further damage to an adjacent building or other structure, or in the case of an open environment preventing the barrier arm from swinging out beyond a point necessary for the vehicle to pass through. One means for safely allowing the barrier arm to swing out is to have a hinge stop that prevents the hinge leaves from swing out completely. Alternately, a chain mechanism (not shown) is equally preferable. FIGS. 1 and 2 disclose a one embodiment. However, a chain mechanism would work in a manner such that the barrier is prevented from again completely swinging out. Thus, the chain would be tied at one to the barrier and on the other end to a suitable point to resist the forces of the swinging barrier arm after the chain is fully extended.

The plate assembly 5 comprises a plate and a tubular assembly 7 fixedly attached thereto by suitable means for holding the barrier arm 1. Of course, it is to be understood that the tubular assembly 7 can be of any shape including rectangular to hold a rectangular barrier arm in place. The barrier arm 1 extends longitudinally from the plate assembly 5 thereby creating a barrier so as to prevent vehicles from crossing the barrier gate assembly 10. The barrier arm 1 is held in place by suitable means 6 including wing nuts and the like for easy maintenance and removal of the barrier arm in case of breakage. The barrier arm 1 is preferably made of circular Polyvinyl Chloride (PVC) material but any other material may be used including wooden planks. A wooden plank may be necessary where a more secure environment is desired as a wooden barrier arm appearance may prevent a deliberate offense to the barrier gate assembly 10. The barrier arm 1 may be further provided with a polyurethane foam 2 to prevent scrapping and/or scratching the vehicle. The circular or rectangular barrier arm 1 should include a bright color polyurethane foam and/or install fluorescent stripes as a further safety factor.

Now referring to FIGS. 1 and 2, a description of the method of operation is provided. In the normal mode of operation, the barrier arm assembly 12, relative to the driving surface, rotates upward 14 in a open position and rotates downward 15 in a closed position. The bracket assembly 4 and the plate assembly 5 are thus ordinarily aligned adjacent to each other and are in contact with each other because of the magnetic forces provided by the magnet 9. Sensing means (not shown) of a control unit of the automatic vehicle gate operating mechanism 11 are activated by only an authorized vehicle or an operator through a remote switch. Of course, in the case of a toll booth, the barrier gate assembly 10 operation may also be connected to an automatic coin collection means as is conventionally used. Thus, as soon as coins are deposited and accounted, the barrier gate assembly 10 will operate allowing the vehicle to pass through the barrier gate assembly 10. The automatic vehicle gate operating mechanism 11 upwardly pivots the barrier arm assembly 12 raising the barrier arm 1 to the open position as indicated by a curving arrow upward 14 in FIG. 4, to permit passage of a vehicle through the barrier gate assembly 10.

During ordinary operation, the sensing means would cause the automatic vehicle gate operating mechanism 11 to lower the arm 10 after the vehicle has passed through the gateway. If, however, the barrier arm 1 is, either intentionally or unintentionally, lowered downward 15 in a closed position, as indicated by a curving arrow downward 15 in FIG. 1, when the vehicle 50 is still passing through the barrier gate assembly 10, the polyurethane sleeve 2 surrounding the barrier arm 1 will contact the vehicle preventing damage to the vehicle. The polyurethane (soft) sleeve 2, thus, cushions the initial impact of the barrier arm 1 against the vehicle. Moreover, the force of the vehicle impact on the barrier arm 1 will overcome the magnetic forces holding the barrier arm assembly 12 in resting place allowing it to swing out away from the vehicle as it passes by as indicated in FIG. 2. The hinge assembly safety stop 8 also prevents the barrier arm from swinging out completely avoiding further damage to an adjacent building or other structure, or in the case of an open environment preventing the barrier arm from swinging out beyond a point necessary for the vehicle to pass through.

Although the invention has been described herein for the purpose of illustration, it is understood that various conventional attachments may be made to the barrier gate assembly 10 in accordance with the current prior art technology and the needs of the operator. Thus, changes and modifications in the specifically described embodiments may be carried out without departing from the scope of the invention which is intended to be limited only by the scope of the appended claims.

We claim:

1. A vehicle barrier gate comprising:

(a) an automatic gate operating mechanism comprising: an electrical motor, a control mechanism operatively associated with the electric motor, a gear mechanism operatively associated with the electric motor, and a pivoting member operatively associated with the gear mechanism; and, (b) a barrier arm assembly operatively associated with the pivoting member for blocking vehicular movement through a restricted when the barrier arm assembly is positioned in a relatively horizontal position while allowing vehicular movement through the restricted area when the barrier arm assembly is pivoted to a relatively vertical position; and, (c) wherein the barrier arm assembly comprises: an elongate metal bracket fixedly attached to the pivoting member; a hinge assembly fixedly attached to the elongate bracket such that the longitudinal axis of the hinge assembly is at a relatively transverse angle of between 60 to 90 degrees with respect to the longitudinal axis of the elongate bracket; an elongate metal plate fixedly attached to the hinge assembly such that the longitudinal axis of the elongate plate is at a transverse angle of 90 degrees with respect to the longitudinal axis of the hinge assembly; a hinge stop mechanism located on the hinge assembly such that the elongate plate is prevented from hinge rotation greater than 120 degrees relative to the elongate bracket; a magnet fixedly attached to the elongate bracket for holding the elongate bracket and the elongate plate in adjoining alignment; and an elongated barrier arm fixedly attached to the elongate plate.

2. A method for regulating vehicular traffic through a restricted area, wherein the method comprises:

(a) operating an automatic gate operating mechanism to raise a barrier arm assembly to a relatively vertical position from a resting horizontal position to thereby allow vehicular traffic through the restricted area and to lower the barrier arm assembly to the resting horizontal position to thereby prevent vehicular traffic through the restricted area;

(b) wherein the automatic gate operating mechanism comprises: an electrical motor, a control mechanism operatively associated with the electric motor, a gear mechanism operatively associated with the electric motor, and a pivoting member operatively associated with the gear mechanism;

(c) wherein the barrier arm assembly is operatively associated with the pivoting member to thereby pivotably raise and lower the barrier arm assembly; and (d) wherein the barrier arm assembly comprises: an elongate metal bracket fixedly attached to the pivoting member; a hinge assembly fixedly attached to the elongate bracket such that the longitudinal axis of the hinge assembly is at a relatively transverse angle of between 60 to 90 degrees with respect to the longitudinal axis of the elongate bracket; an elongate metal plate fixedly attached to the hinge assembly such that the longitudinal axis of the elongate plate is at a transverse angle of 90 degrees with respect to the longitudinal axis of the hinge assembly; a hinge stop mechanism located on the hinge assembly such that the elongate plate is prevented from hinge rotation greater than 120 degrees relative to the elongate bracket; a magnet fixedly attached to the elongate bracket for holding the elongate bracket and the elongate plate in adjoining alignment; and an elongated barrier arm fixedly attached to the elongate plate.

* * * * *